US009591878B2

(12) United States Patent
Applewhite

(10) Patent No.: US 9,591,878 B2
(45) Date of Patent: Mar. 14, 2017

(54) SNAPLESS NURSE AND PUMP BANDEAU BRASSIERE

(71) Applicant: Nkese Capitola Applewhite, Hudson, NH (US)

(72) Inventor: Nkese Capitola Applewhite, Hudson, NH (US)

( * ) Notice: Subject to any disclaimer, the term of this patent is extended or adjusted under 35 U.S.C. 154(b) by 173 days.

(21) Appl. No.: 14/536,643

(22) Filed: Nov. 9, 2014

(65) Prior Publication Data

US 2015/0133028 A1 May 14, 2015

Related U.S. Application Data

(60) Provisional application No. 61/903,030, filed on Nov. 12, 2013.

(51) Int. Cl.
*A41C 3/04* (2006.01)
*A41C 3/06* (2006.01)

(52) U.S. Cl.
CPC . *A41C 3/04* (2013.01); *A41C 3/06* (2013.01)

(58) Field of Classification Search
CPC ..... A41D 7/00; A61M 1/06; A41F 15/002; A41C 3/00; A41C 3/0014; A41C 3/04
USPC ..... 450/65–67, 88, 36, 69, 68, 74–76; 2/4, 2/105, 106
See application file for complete search history.

(56) References Cited

U.S. PATENT DOCUMENTS 1,863,697 A * 6/1932 Rutledge ..... D04B 1/246 450/66
2,352,866 A * 7/1944 Stacy ..... A41C 3/00 450/66
2,585,338 A 2/1952 Meares
2,666,919 A 1/1954 Spangard
2,925,816 A 2/1960 Rosenthal
3,939,845 A 2/1976 Guidoni
4,222,387 A 9/1980 Tetu
4,390,024 A 6/1983 Williams
4,531,525 A * 7/1985 Richards ..... A41C 3/0014 450/65
4,633,876 A 1/1987 Scullin
4,640,287 A 2/1987 Anderson et al.
4,911,677 A 3/1990 White
5,024,628 A 6/1991 Sanchez
5,119,511 A * 6/1992 Packer ..... A41D 7/00 2/67
D366,351 S * 1/1996 Winchell ..... D2/706
6,015,331 A 1/2000 Ioakim
6,186,861 B1 * 2/2001 Flaherty ..... A41F 15/002 450/1
6,705,920 B1 * 3/2004 Engel ..... A61M 1/06 2/338
8,137,153 B2 * 3/2012 Bell ..... A61M 1/06 450/36
2011/0092134 A1 * 4/2011 Alva ..... A41C 3/04 450/36
2014/0364035 A1 * 12/2014 Abbaszadeh ..... A61M 1/062 450/36

(Continued)

*Primary Examiner* — Gloria Hale
(74) *Attorney, Agent, or Firm* — Z IP Law PLLC; Claire Zopf

(57) ABSTRACT

A nursing brassiere comprising an outer fabric layer affixed to a lower fabric layer along edge seams with a single attachment point within the center of the brassiere making it usable for both nursing and hands-free pumping.

19 Claims, 11 Drawing Sheets

(56) References Cited

U.S. PATENT DOCUMENTS

| | | | | |
|---|---|---|---|---|
| 2014/0364036 | A1* | 12/2014 | Abbaszadeh | A61M 1/062<br>450/36 |
| 2015/0133028 | A1* | 5/2015 | Applewhite | A41C 3/06<br>450/36 |

* cited by examiner

SNAPLESS NURSE AND PUMP BANDEAU BRASSIERE

RELATED PATENT APPLICATIONS

This application claims the benefit of U.S. Provisional Patent Application No. 61/903,030 filed Nov. 12, 2013 entitled SNAPLESS NURSE AND PUMP BANDEAU BRASSIERE which is hereby incorporated herein by reference in the entirety.

FIELD OF THE INVENTION

The present invention is related to a nursing brassiere with fully removable straps composed of two fabric layers making it usable for both nursing and hands-free pumping.

BACKGROUND OF THE INVENTION

For a new mother finding a stylish under garment that allows them to discreetly and easily nurse their child proves a challenge. Many such garment designs forego style for functionality with complicated metal or plastic hooks and snaps. The breast cup may fold up from the support band of the brassiere and be affixed to a fastener on the strap to align the breast cup around the breast. The fastener may be a snap or hook that requires some awkward manipulation to remove or reattach the breast cup to nurse. Other designs may use a fabric adhesive such as a hook and loop material commercially sold under the Trademark VELCRO such as U.S. Pat. No. 5,024,628 to Sanchez that has an upper band of VELCRO along the entire edge of the breast cup with the band mating with a lower band of VELCRO surrounding the breast for attachment of the breast cup. The stiffness of the extended bands of VELCRO may reduce the comfort of the wearer and may cause bulging around the breast cup under a garment. Another design as shown in U.S. Pat. No. 4,911,677 to White implores small VELCRO pieces along the lower band of the brassiere that may not adequately secure the breast cup and that require the woman to pull and hold the breast cup up and away while nursing. Another fastener free brassiere in U.S. Pat. No. 4,633,876 to Scullin discloses each breast cup having a series of panels and seams with two or more fold-over panels, an upper bust panel, and an underbust panels having center seams along the breast cup. The opening of the breast cup may require some dexterity and therefore time to expose the entire areola for comfortable nursing of an infant. These designs further fail to disclose a brassiere that provides for hands-free support of a nursing pump while pumping, an objective of the present invention.

OBJECTS AND SUMMARY OF THE INVENTION

The present invention is related to a nursing brassiere that uses a layering of fabric to easily access a breast for nursing, that may keep the upper portion of the breast covered for discreet infant feeding or pumping. The nursing brassiere may have straps or preferably have removable straps and be in the form of a bandeau that provides as much, if not more, support as a regular brassiere. Because the nursing brassiere does not have a snap-down fastener along the strap, there is no need for permanently attached straps. The straps are therefore fully removable and fully customizable so the nursing brassiere may be worn as a halter, crisscross back, or strapless garment. The nursing brassiere may therefore be worn under any type of clothing, including formal wear and summer clothing such as maxi dresses. The nursing brassiere may further be incorporated into swimming suits and tank tops with or without straps providing for infant nursing without the complete removal of the garment.

In an embodiment, the outer fabric layer is attached to a support band that may have sets of adjustable fasteners in the rear of the support band to adjust and comfortably attach the brassiere. In other embodiments, the outer fabric layer and support band may be made from a synthetic fiber or cotton or lace blend with a suitable omni-directional stretchable material such as spandex or elastane to eliminate the need for a hook and eye or other type of adjustable fasteners for closure. The stretchable material may further be of a thickness and softness to cushion the breast and provide absorbency. The under layer may be of a similar stretchable material and in this way provide for comfort and expansion as breast size may change overtime while nursing. The outer fabric layer may be a single piece of stretchable material that provides for the nursing brassiere to be embellished with stretch lace and/or other design elements. Therefore, from an outer view, the nursing brassiere looks like a normal brassiere or bandeau bra, and the bi-layer spandex construction is almost seamless under clothing. Unlike the panels, seams and fasteners that are on, in and around the breast cups of the prior art, the single piece construction provides for nursing brassiere of the present invention to be both stylish and functional. A woman can therefore wear this bra all day and into the evening without having to switch into a different brassiere to nurse or express breast milk using a pump.

It is therefore, a primary object of the invention to provide for a nursing brassiere with an outer fabric layer that may be opened over either breast or both breasts at the same time which does not require any hooks, snaps, or other fastening means.

It is a further object of the present invention to provide for a nursing brassiere with a stylish one piece outer fabric layer that has smooth lines which aid in the comfort of the wearer and create an aesthetically pleasing affect.

In addition, the nursing brassiere should provide flexibility in appearance with removable straps while still providing proper support when wearing the nursing brassiere strapless.

Another objective is that the nursing brassiere should in overall appearance and detail be no different in looks and function than a regular, ordinary brassiere, except for the fact that the nursing brassiere provides access to the breasts for nursing or pumping.

Another object of the present invention is to provide support using the outer and under layer to hold a nursing pump to provide for hands-free pumping.

It is another object of the present invention to provide for a nursing brassiere wherein the construction provides for sufficient support of the breasts so as to preclude any portion of the nursing brassiere from pulling away from the body during wear.

It is yet another object of the present invention to provide for a nursing brassiere which has as much, if not more, support as a regular brassiere, which is vital because of breast enlargement and sensitivity during such time period.

It is yet another object of the present invention to provide for a nursing brassiere made from an omni-directional synthetic fiber or a synthetic fiber blend which can comfortably expand and contract as do a nursing mother's breasts.

It is yet another object of the present invention that the stretchable material such as spandex stretches to eliminate the need for a hook and eye or other type of closure. The wearer may therefore either step into the nursing brassiere or pull the brassiere over their head to put on the nursing brassiere.

It is yet a further object of the present invention that an opening is created by lifting the bottom of the outer fabric layer up and lowering the top of the inner layer down providing a discreet covering of the upper breast while making access to the breast easy for nursing or pumping.

It is yet a further object of the present invention that an opening is created by pulling the top of the outer fabric layer down and lowering the inner layer providing easy accessibility to the breast and providing additional support to hold a nursing pump for hands-free pumping.

The present invention is related to a nursing brassiere comprising a bandeau having a bra portion, the bra portion having a left side edge, a right side edge and a center area; a fabric layer affixed along the left side edge, affixed along the right side edge and affixed to a single attachment point within the center area; and wherein the fabric layer may be separated from the bra portion to expose a nipple of the breast. The fabric layer of the nursing brassiere may be affixed to an outer surface of the bra portion or alternatively to an inner surface of the bra portion. The fabric layer of the nursing brassiere may be formed from a single piece of fabric. The fabric layer may be attached to the bra portion at a single attachment point using a bar tack. The fabric layer may be of a stretchable material. The single attachment point of the nursing brassiere may provide for the fabric layer and bra portion to support a breast pump. The fabric layer of the nursing brassiere may be made from an absorbent material. The bandeau of the nursing brassiere may have removable straps.

The present invention is further related to a nursing brassiere comprising a support bandeau having a bra portion, the bra portion having a left cup area, a right cup area and a cleavage area between the left and right cup area; a fabric layer affixed along an outer edge of the left cup area and along an outer edge of the right cup area, and affixed to a center point within the cleavage area using a bar tack; and wherein the fabric layer may be separated from the bra portion to expose one or both nipples of the breast for nursing or pumping. The fabric layer of the nursing brassiere may be affixed to an outer surface of the bra portion or alternatively to an inner surface of the bra portion. The fabric layer of the nursing brassiere may be formed from a single piece of fabric. The fabric layer may be of a stretchable material. The attachment at the center point may provide for the fabric layer and bra portion to support a breast pump. The fabric layer may be of an absorbent material. The support bandeau of the nursing brassiere may have removable straps.

The present invention is further related to a nursing brassiere for hands-free pumping to a breast pump comprising a fabric layer affixed to a single attachment point within a cleavage area of a nursing brassiere using a bar tack, the fabric layer also affixed to side edges of a bra portion of the nursing brassiere; and wherein the fabric layer is pulled downwards exposing the bra portion of the nursing brassiere and the bra portion is pulled upwards exposing the breast and a nursing flange of a breast pump is inserted below the fabric layer and below the bra portion to support the flange and provide for hands-free pumping to the breast pump. The fabric layer and bra portion of the nursing brassiere for hands-free pumping to a breast pump may be formed from stretchable material.

Other objects and advantages of the present invention will become obvious to the reader and it is intended that these objects and advantages are within the scope of the present invention. To the accomplishment of the above and related objects, this invention may be embodied in the form illustrated in the accompanying drawings, attention being called to the fact, however, that the drawings are illustrative only, and that changes may be made in the specific construction illustrated and described within the scope of this application.

BRIEF DESCRIPTION OF THE DRAWINGS

Several embodiments of the present invention will now be described by way of example only, with reference to the accompanying drawings in which.

DETAILED DESCRIPTION OF THE DRAWINGS

Figure 1A:
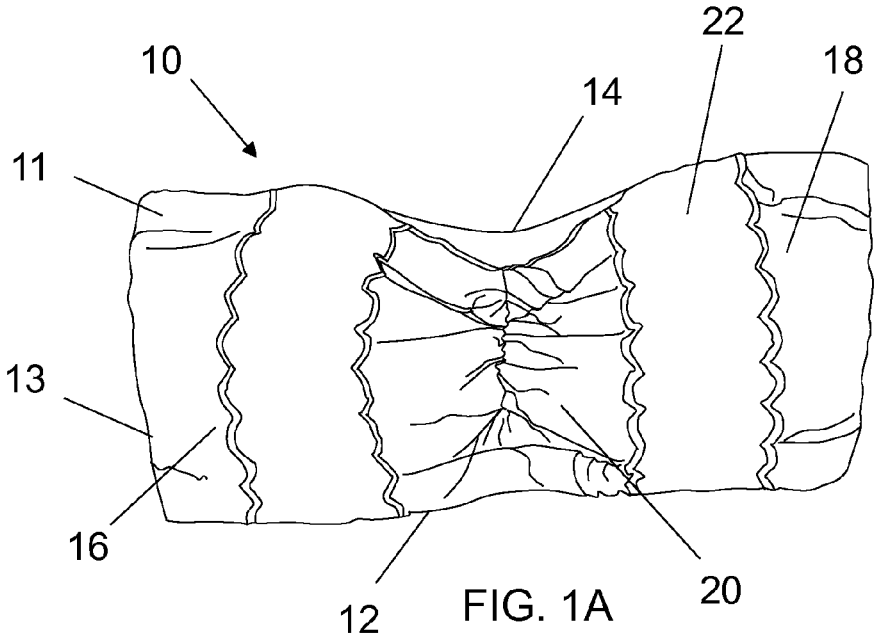
FIG. 1A is a front perspective view of an embodiment of the nursing brassiere of the present invention in the form of a strapless bandeau.
Figure 1B:
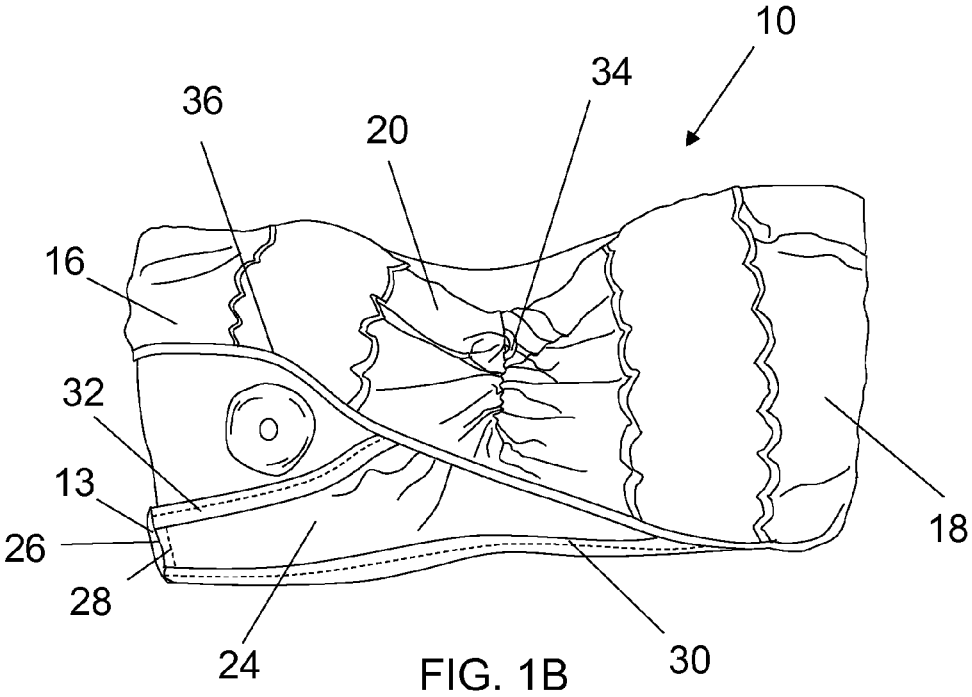
FIG. 1B is a front perspective view of an embodiment of the nursing brassiere of the present invention with the layers separated to expose a breast.

The nursing brassiere 10 of present invention is shown in FIG. 1A in a first embodiment in the form of a bandeau 11. The bandeau 11 of the nursing brassiere 10 may be formed from a single piece of stretchable material that extends from a front bra portion 12 to a rear portion 14. The front bra portion 12 having left and right cup areas 16 and 18 that are separated by a cleavage portion 20. Decorative design elements 22 may be added to the material to stylize and beautify the nursing brassiere 10. As shown in FIG. 1B, the front bra portion 12 may be pulled up from either the left cup area 16 as shown or the right cup area 18 to expose a lower fabric layer 24 that covers all or a portion of the woman's breast. The lower fabric layer 24 may be pulled down to expose the nipple of the breast providing for an infant's mother to nurse or pump. In a preferred embodiment, the lower fabric layer 24 is a single piece of material that has each side edge 26 sewn along a seam 28 to a side portion 13 or the rear portion 14 of the bandeau 11. In other embodiments, the fabric layer 24, may be formed from more than one piece of material. A lower pleated portion 30 formed from the bottom edge of the lower fabric layer 24 may extend with the bandeau 11 along the front bra portion 12 with the lower pleated portion 30 not being attached to the front bra portion 12 providing for the bra portion 12 to be separated from the lower fabric layer 24. An upper pleated portion 32 of the lower fabric layer 24 extends from the edge seam 28 along the front bra portion 12. The lower fabric layer 24 is attached to the bra portion 12 using a single stitch or bar tack 34 that serves as a single attachment point within the cleavage portion 20 of the nursing brassiere 10. The bar tack 34 at the upper center within the cleavage portion 20 of the garment acts as an anchor so that only the nipple is exposed when nursing or pumping with the front bra portion 12 and lower fabric layer 24 covering the breast. A woman can therefore minimize the amount of her breast that must be exposed for nursing. The lower edge 36 of the bandeau 11 may have an elastic band for additional support to hold the front bra portion 12 against the upper breast to expose the nipple.

Figure 2:
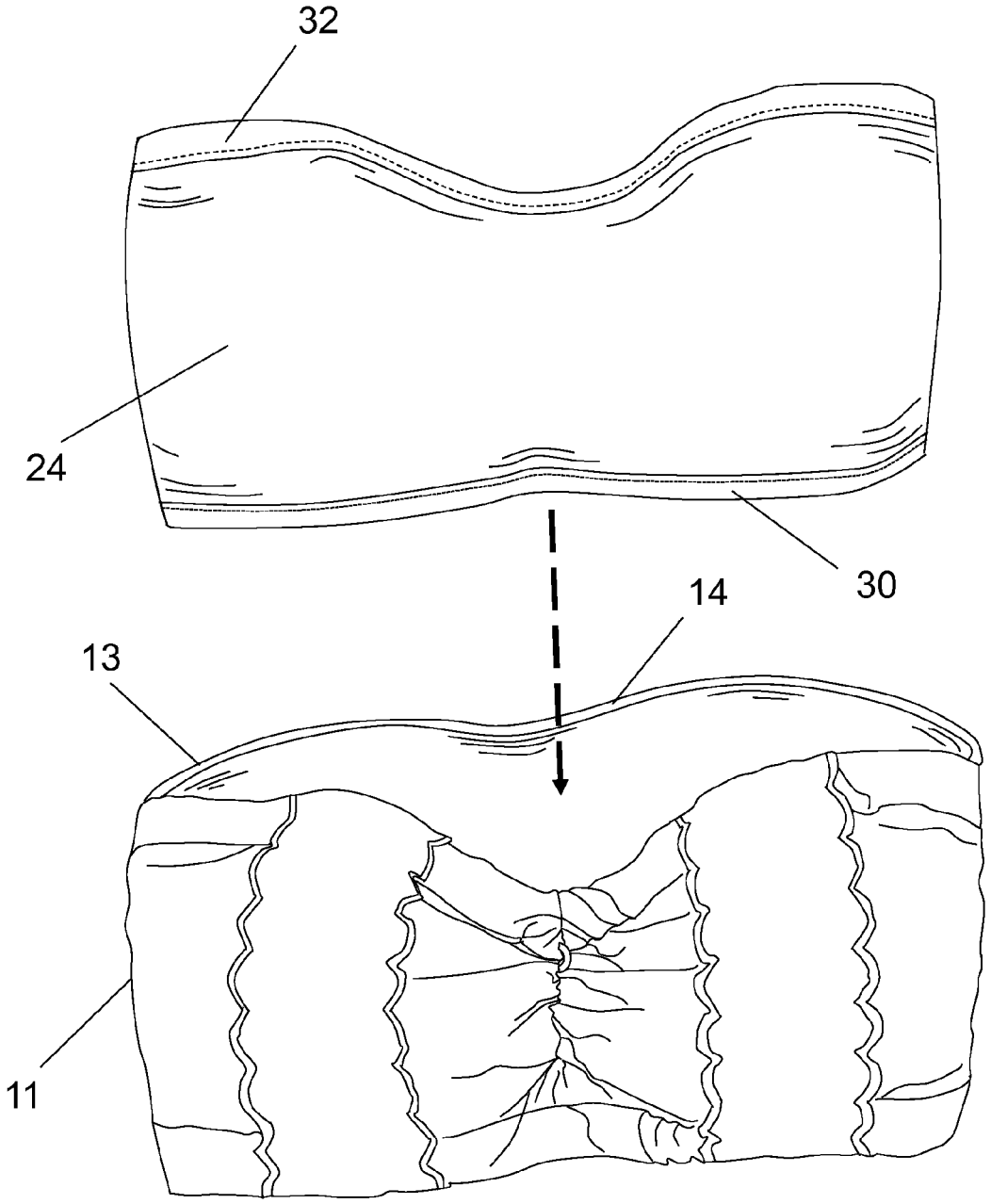
FIG. 2 is a front perspective view of an embodiment of an inner fabric layer being inserted into the nursing brassiere of the present invention.
Figure 3A:
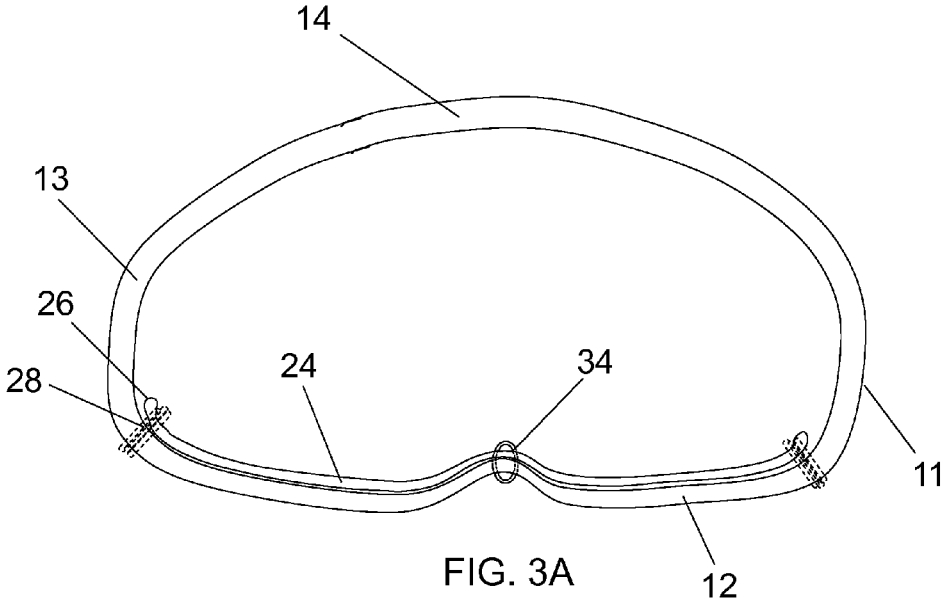
FIG. 3A is a top view of an embodiment of an inner fabric layer being affixed to the nursing brassiere of the present invention.

As shown in FIG. 2, the lower layer 24 is inserted into and affixed to the bandeau 11 at its side edges 26 and at the single attachment point using the bar tack 34. The fabric layer 24 may be a soft stretchable foam like absorbent material. The stretchability and softness of the material of the inner layer 24 comfortably supports the breasts and the absorbency removes any requirement for additional pads. As shown in FIG. 3A, the inner fabric layer 24 is dimensioned to an adequate length to be aligned along the front bra portion 12 and extend around the bandeau 11 to be attached at any point along the side and rear portions 13 and 14 with the edge seam 28 attachment area on each edge 26 of the inner fabric layer 24 determined by the required cup size and support necessary for a particular nursing brassiere 10.

Figure 3B:
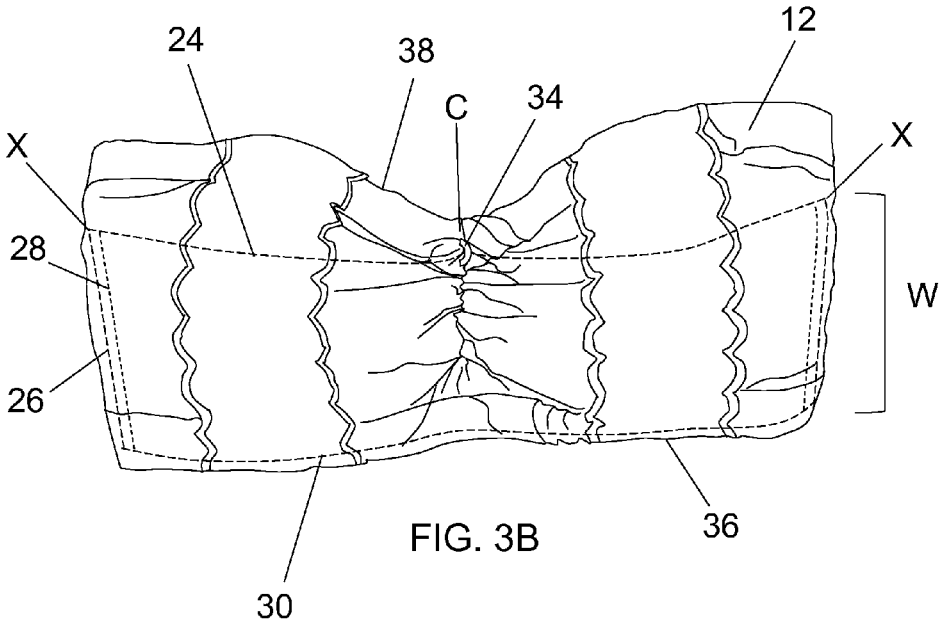
FIG. 3B is a front elevation view of an embodiment of an inner fabric layer being affixed to the nursing brassiere of the present invention.
Figure 4A:
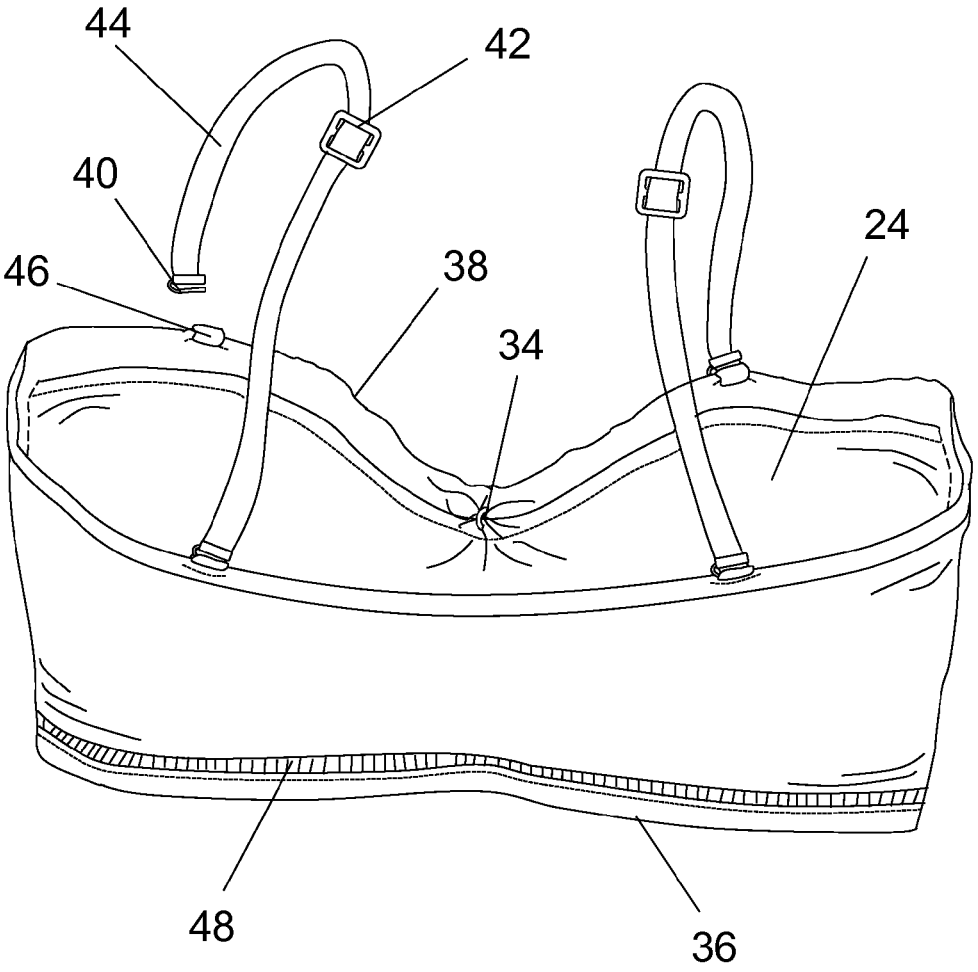
FIG. 4A is a rear perspective view of an embodiment of the nursing brassiere of the present invention with an inner fabric layer and removable straps.
Figure 4B:
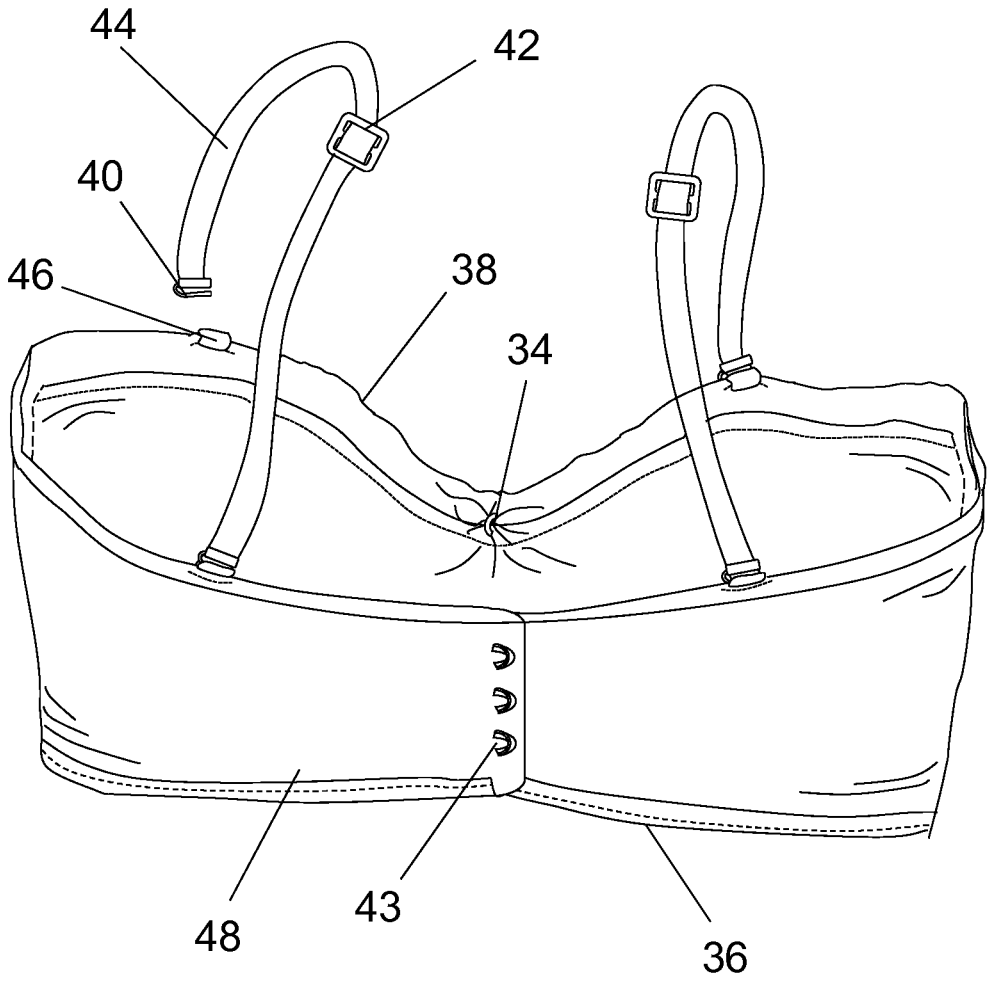
FIG. 4B is a rear perspective view of another embodiment of the nursing brassiere of the present invention with an inner fabric layer, removable straps and an adjustable support band.

As shown in FIG. 3B, the front bra portion 12 completely covers and hides the inner layer 24 and also covers the front of the bust of the wearer. The inner fabric layer 24 may also cover all or only a portion of the bust of the wearer. The fabric layer may have a width W that from the bottom edge 36 of the front bra portion 12 extends up and over the bust of the wearer to a point X that may be from about ½ to 2½ inches below the top edge 38 of the front bra portion 12. The top edge 38 of the front bra portion 12 is affixed to a midpoint C of the inner fabric layer 24, such that the attachment point held with bar tack 34 creates a slight dip to form and surround the breasts of the wearer. The lower portion 30 of the inner fabric layer 24 and the bottom edge 36 of the front bra portion 12 end between ½ to 1½ inches below the bust of the wearer to create a supportive full band with the side edges 26 of the inner layer 24 attached to the bandeau 11 using the side seams 28. The width W and point of attachment X along the front bra portion 12 is again determined by the bust size and support necessary for the nursing brassiere 10 to be comfortably worn and provide access for nursing without any requirement that the wearer unsnap, unfasten, unhook, or otherwise detach a cup portion to expose the nipple. In a further embodiment, the bandeau 11 may provide hooks 40 and strap adjustment sliders 42 to add to or remove shoulder straps 44 from the nursing brassiere 10 as shown in FIG. 4A. The nursing brassiere 10 may further have one or more sets of attachment hooks 43 or other fixtures in the rear portion 14 to have a support band instead of a bandeau 11 so that the nursing brassiere 10 is adjustable to fit wearers of different sizes as shown in FIG. 4B. A strap attachment loop 46 for example may be sewn on or near the top edge 38 of the front bra portion 12 to provide for the hook 40 to be inserted into the loop 46 to attach the strap 44. For additional support, an elastic stretch band 48 may be sewn in to the bottom edge 36 of the bandeau 11 of the nursing brassiere 10.

Figure 5:
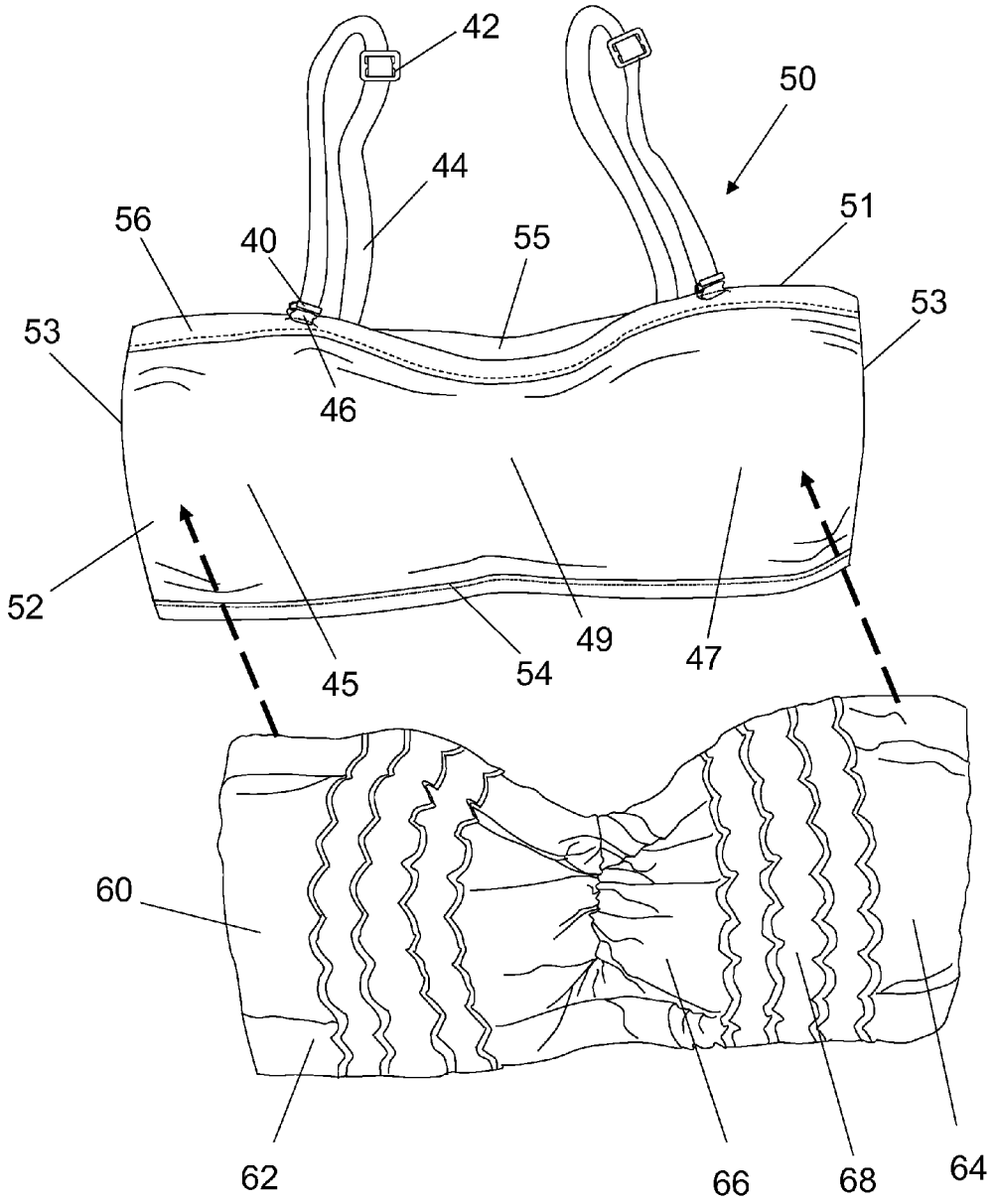
FIG. 5 is a front perspective view of a another embodiment of the nursing brassiere of the present invention with an outer fabric layer affixed to the bra portion of the nursing brassiere.

As shown in FIG. 5, the nursing brassiere 50 may in a further embodiment, instead have an outer fabric layer 60 that is affixed to a support bandeau 51. Similar to the inner fabric layer 24, the outer fabric layer 60 may have left and right breast cup areas 62 and 64 that are separated by a cleavage area 66. The outer fabric layer 60 may also have decorative design elements 68. The bandeau 51 may have a front bra portion 52, side portions 53 and a rear portion 55. The front bra portion 52 has left and right cup areas 45 and 47 and a cleavage portion 49. The bandeau 51 may also have adjustable shoulder straps 44 using sliders 42, and the straps may have hooks 40 and loops 46 or other releasable fastening devices to have the straps 44 be removable from the bandeau 51. Alternatively the nursing brassiere 50 may be strapless.

Figure 6:
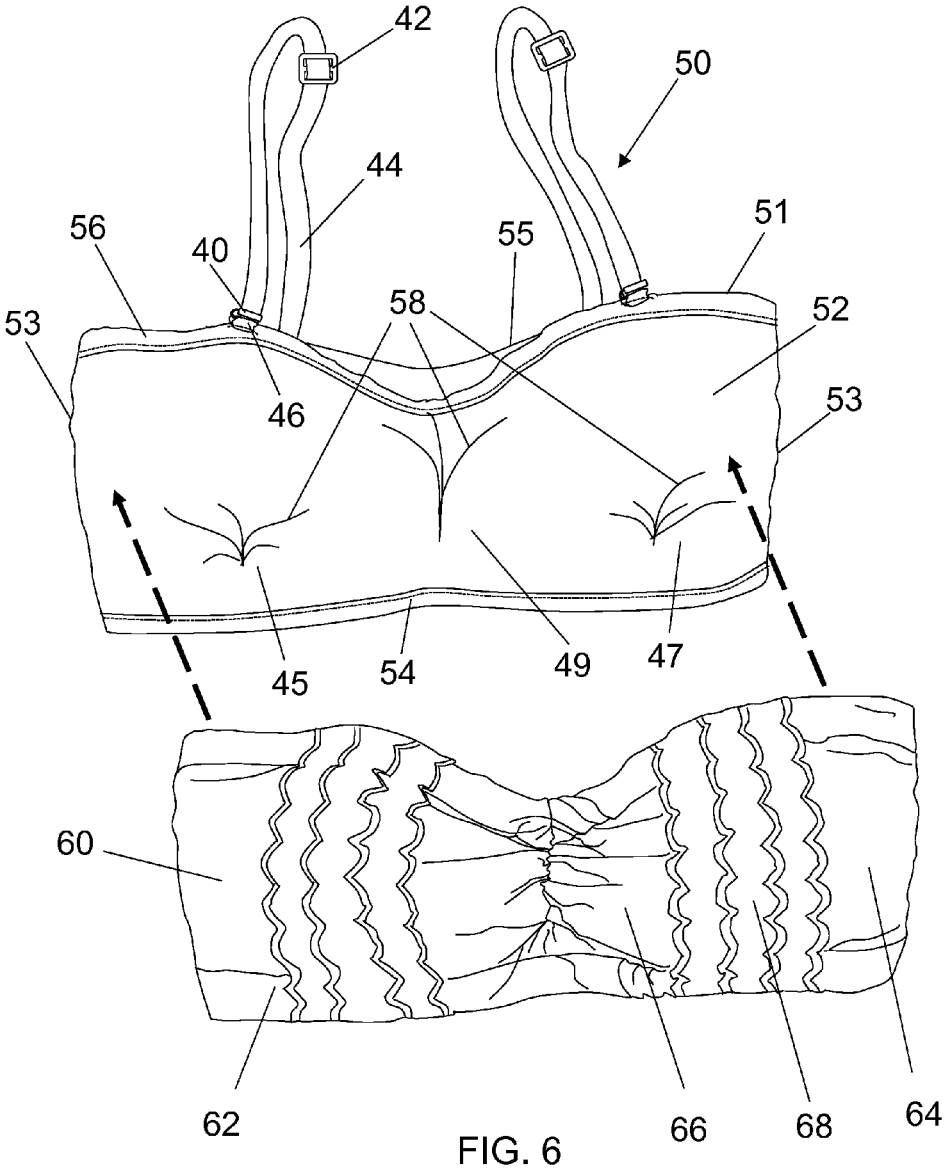
FIG. 6 is a front perspective view of a still further embodiment of the nursing brassiere of the present invention with an outer fabric layer affixed to the bra portion of the nursing brassiere.

The front bra portion 52 of the support bandeau 51 of the nursing brassiere 50 may have a slightly smaller surface area within the bra portion 52 and therefore be of slightly smaller dimensions than the outer fabric layer 60 so that the outer fabric layer 60 completely covers the front bra portion 52. The bandeau 51 may also have an upper edge 56 and a bottom edge 54 that may be pleated as described in other embodiments to have a tactile surface for the wearer to pull up or down to expose the nipple of the breast. The bandeau 51 may also similarly have an elastic band for additional support as required by the bust size of the wearer. The bandeau 51 may be of a soft stretchable material that may be absorbent to remove any requirement for additional pads, although in other embodiments the bra portion 52 may provide for a removable pad. In this and other embodiments, the bra portion 52 may also have stays, underwire, and/or have pre-formed cups 58 to support the wearer's breasts as shown in FIG. 6.

Figure 7A:
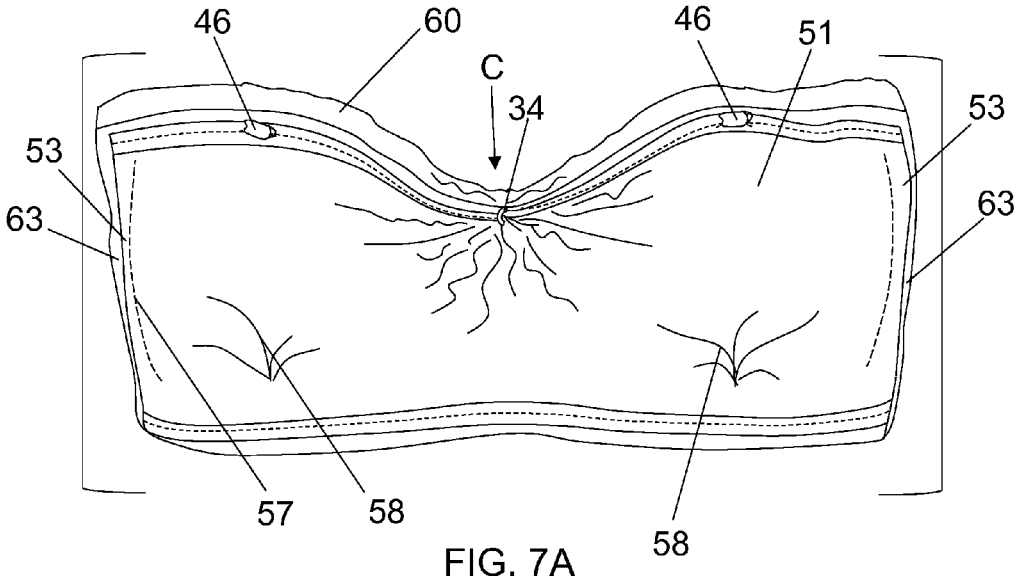
FIG. 7A is a cross-sectional view of an embodiment of the nursing brassiere of the present invention with an outer fabric layer affixed to the bra portion of the nursing brassiere.
Figure 7B:
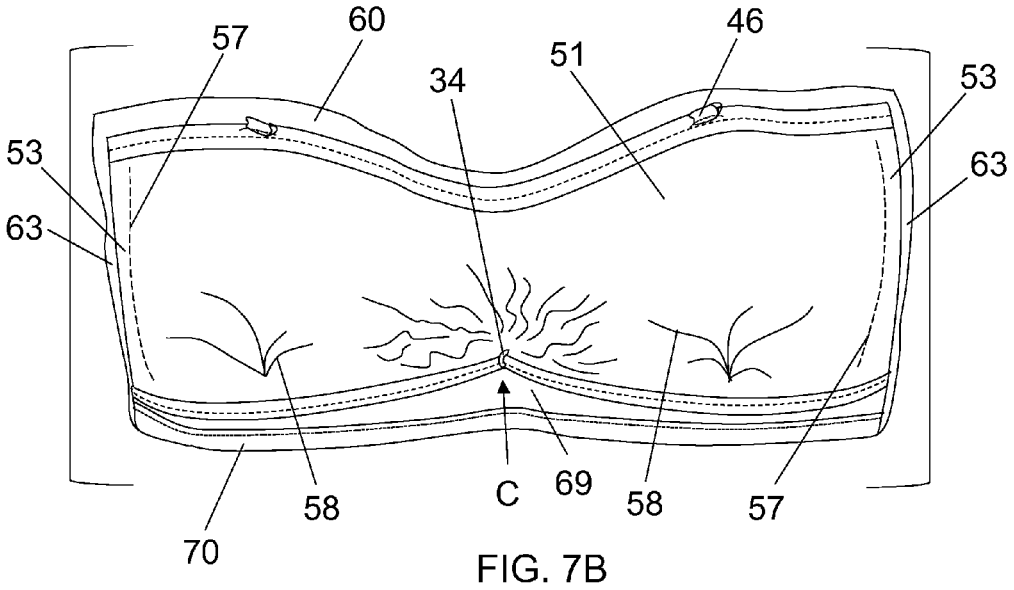
FIG. 7B is a cross-sectional view of another embodiment of the nursing brassiere of the present invention with an outer fabric layer affixed to the bra portion of the nursing brassiere.

In cross-sectional rear view that does show the rear portion 55 of the bandeau 51, the outer fabric layer 60 is attached within side edge portions 63 to the outer side portion 53 or the rear portion 55 of the bandeau 51 along seams 57 and to a single attachment point using the bar tack 34 that as shown in FIG. 7A is located at a center point C within the upper cleavage portion 49 of the front bra portion 52. Alternatively, the bar tack 34 may be located at a center point C that is within the lower cleavage portion 49 of the front bra portion 52, as shown in FIG. 7B. In this configuration, a lower portion 69 of the outer fabric layer 60 may extend out below the inner bra portion 52 and the bottom edge 70 may be pleated. Either configuration of the location of the bar tack 34 attachment point is suitable to raise or lower the outer fabric layer 60 over the inner bra portion 52 or in other embodiments raise or lower an outer bra portion 12 over an inner fabric layer 24. The single attachment point of the bar tack 34 may therefore be at any center point C within the cleavage portion where a preference in the location of the bar tack 34 may be determined with respect to the cup size and overall dimensions of the nursing brassiere to adequately and comfortably support the bust of the wearer and provide for minimal manipulations by the wearer to access the nipple for nursing or pumping. Since there are no hooks, snaps or fasteners but only the single attachment point of the bar tack 34 and because the inner fabric layer 24 or outer fabric layer 60 is a single piece, the separation of the layers is simple and may be done with one hand if necessary when the mother is holding the infant.

Figure 8A:
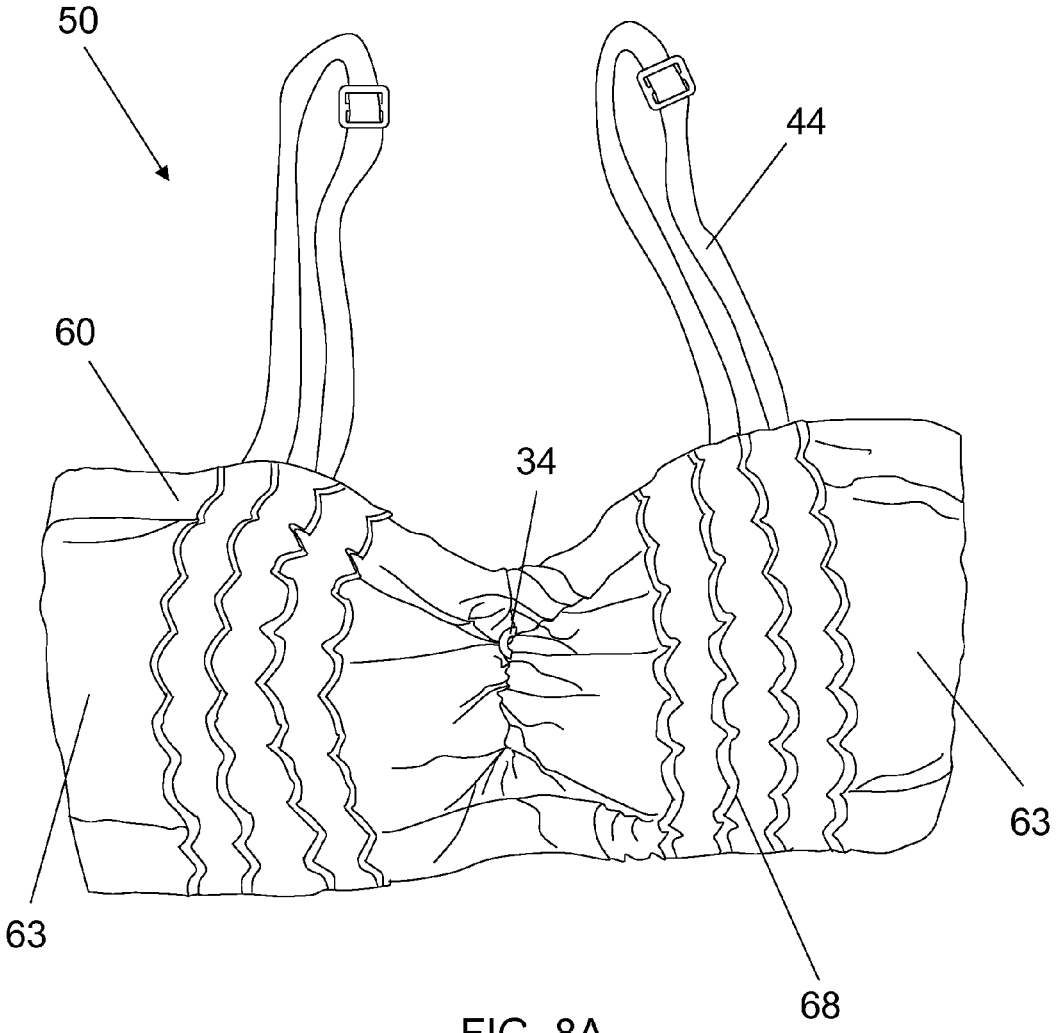
FIG. 8A is a front perspective view of an embodiment of the nursing brassiere of the present invention.
Figure 8B:
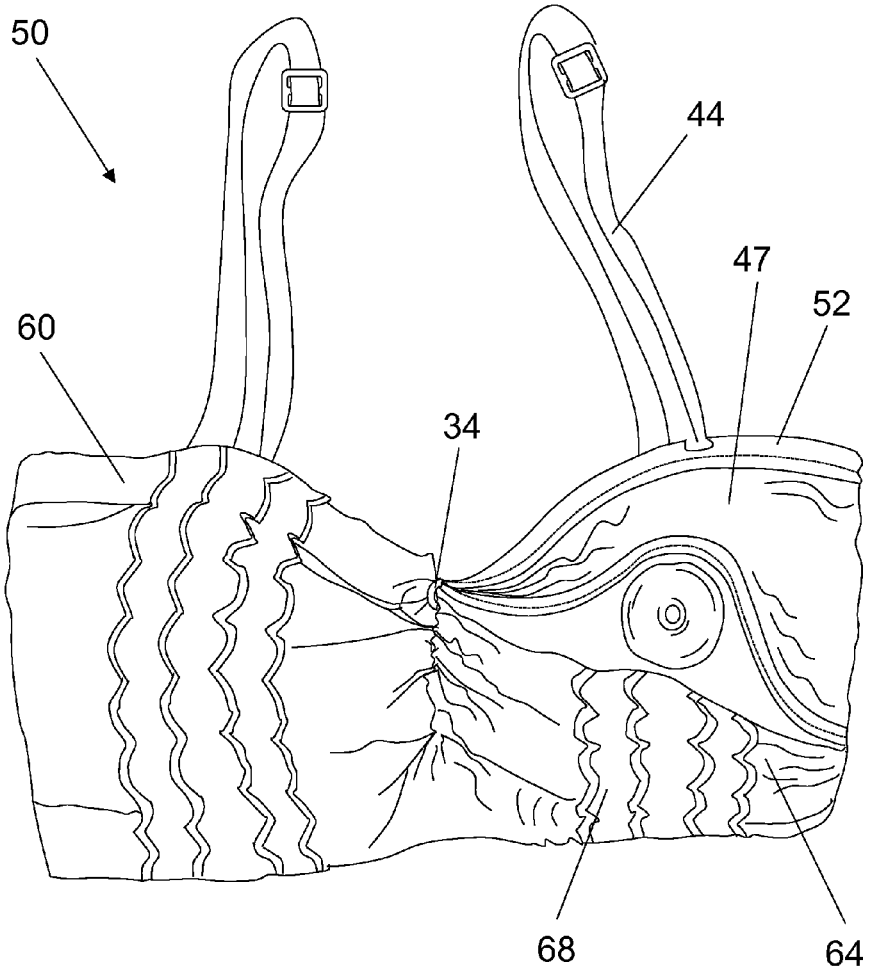
FIG. 8B is a front perspective view of an embodiment of the nursing brassiere of the present invention with the breast exposed.
Figure 9:
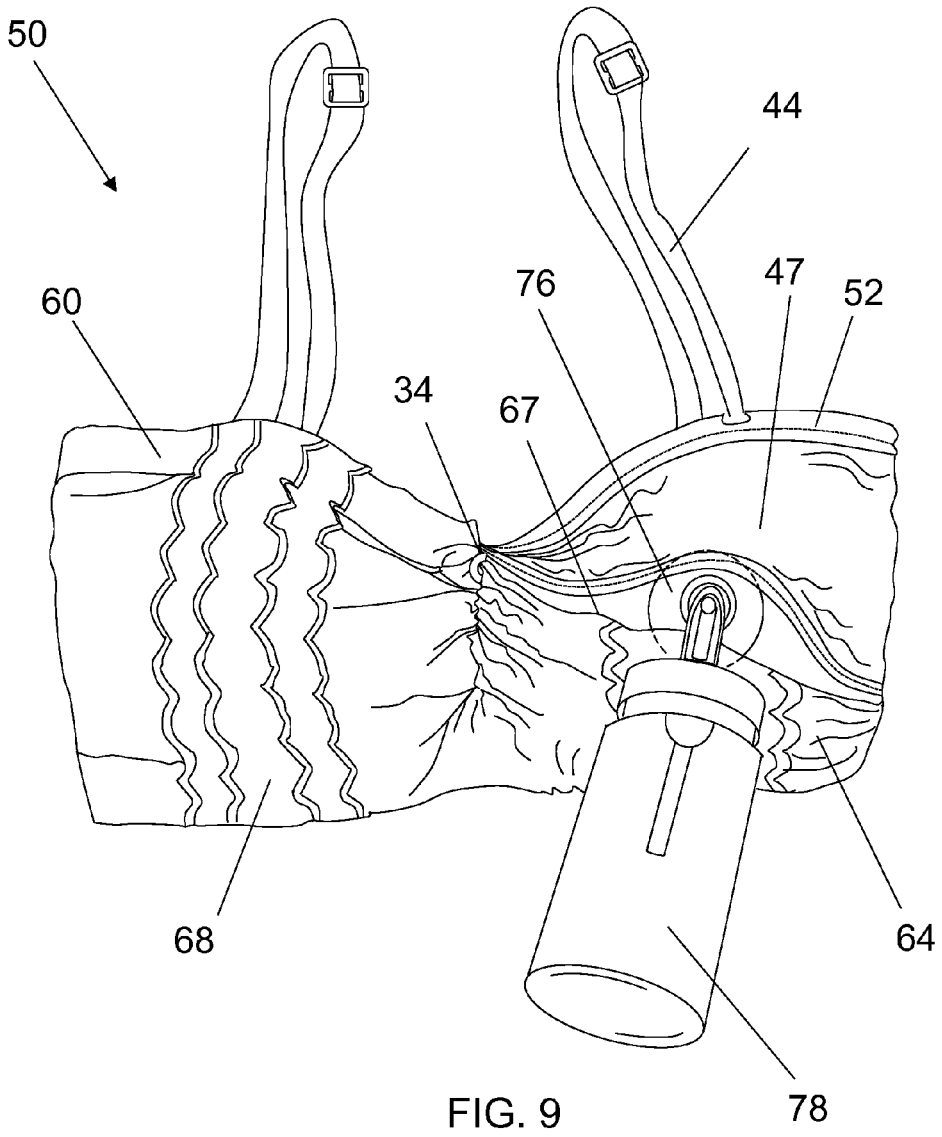
FIG. 9 is a front perspective view of an embodiment of the nursing brassiere of the present invention with a breast pump for hands-free pumping.

As shown in FIG. 8A, the nursing brassiere 50 with the outer fabric layer 60 affixed to the bra portion 52 of the bandeau 51 along the side portions 63 and the single attachment point using the bar tack 34 is similar in support and in every other respect to any other brassiere with the added functionality of providing for the wearer to access the nipple of the breast for nursing. In addition to the functionality described, the single piece outer fabric layer 60 provides for the nursing brassiere 50 to be embellished with stretch lace and/or other design elements 68. As shown in FIG. 8B, the cup area 64 of the outer fabric layer 60 is pulled down and the cup area 47 of the inner bra portion 52 is pulled up to expose the nipple of the breast for nursing. The single attachment point using the bar tack 34 further provides for one or both breasts to be exposed at the same time. The overlay of an upper layer over an inner under layer in embodiments of the nursing brassiere may further provide for hands-free pumping using a breast pump 78. As shown in FIG. 9, by separating the layers, a nursing flange 76 may be inserted below the bottom edge 54 of the cup area 47 of the inner bra portion 52 and below an upper edge 67 of the cup area 64 of the outer fabric layer 60 with the fabric closing around and holding the flange 76 of the breast pump 78. The single fastening point of the bar tack 34 with the vacuum created by the breast pump 78 work together to allow a woman to pump hands-free. The tension of the stretchable material may provide further support to hold the breast pump while supporting the breasts of the wearer.

Although the present invention has been described in some detail by way of illustration and example for purposes of clarity and understanding it will, of course, be understood that various changes and modifications may be made in the form, details, and arrangements without departing from the scope of the invention.

What is claimed is:

1. A nursing brassiere, comprising:

a bandeau having a bra portion, the bra portion having a left side edge, a right side edge and a center area;

a fabric layer dimensioned to be covered by the bra portion of the bandeau and affixed along the left side edge, affixed along the right side edge and affixed to a single attachment point within the center area; and wherein the fabric layer covered by the bra portion may be separated from the bra portion to expose a nipple of the breast for nursing.

2. The nursing brassiere of claim 1 wherein the fabric layer is affixed to the left and the right side edges of the bra portion using side seams sewn along the left and right side edges of the fabric layer.

3. The nursing brassiere of claim 1 wherein the fabric layer is affixed to an inner surface of the bra portion.

4. The nursing brassiere of claim 1 wherein the fabric layer is formed from a single piece of fabric.

5. The nursing brassiere of claim 1 wherein the fabric layer is attached to the bra portion at the single attachment point using a bar tack.

6. The nursing brassiere of claim 1 wherein the fabric layer is of a stretchable material.

7. The nursing brassiere of claim 6 wherein the single attachment point provides for the fabric layer and bra portion to support a breast pump.

8. The nursing brassiere of claim 1 wherein the fabric layer is of an absorbent material.

9. The nursing brassiere of claim 1 wherein the bandeau has removable straps.

10. A nursing brassiere, comprising:

a support bandeau having a bra portion, the bra portion having a left cup area, a right cup area and a cleavage area between the left and right cup area;

a fabric layer dimensioned to cover the bra portion of the support bandeau and affixed along an outer edge of the left cup area and along an outer edge of the right cup area, and affixed to a center point within the cleavage area using a bar tack; and wherein the fabric layer that covers the bra portion may be separated from the bra portion to expose one or both nipples of the breast for nursing or pumping.

11. The nursing brassiere of claim 10 wherein the fabric layer is affixed to an outer surface with seams along the side edge portions of the fabric layer and side portions of the bandeau.

12. The nursing brassiere of claim 10 wherein the fabric layer is affixed to an outer surface of the bra portion.

13. The nursing brassiere of claim 10 wherein the fabric layer is formed from a single piece of fabric.

14. The nursing brassier of claim 10 wherein the fabric layer is of a stretchable material.

15. The nursing brassiere of claim 10 wherein the attachment at the center point provides for the fabric layer and bra portion to support a breast pump.

16. The nursing brassiere of claim 10 wherein the fabric layer is of an absorbent material.

17. The nursing brassiere of claim 10 wherein the support bandeau has removable straps.

18. A nursing brassiere for hands-free pumping to a breast pump comprising:

a fabric layer affixed to a single attachment point within a cleavage area of a nursing brassiere using a bar tack, the fabric layer also affixed to side edges of a bra portion of the nursing brassiere, the bra portion having the cleavage area within a central portion between a left cup area and a right cup area; and wherein the fabric layer is pulled downwards exposing the bra portion of the nursing brassiere and the bra portion is pulled upwards exposing the breast and a nursing flange of a breast pump is inserted below the fabric layer and below the bra portion to support the flange and provide for hands-free pumping to the breast pump.

19. The nursing brassiere for hands-free pumping to a breast pump of claim 18 wherein the fabric layer and bra portion is formed from stretchable material.

* * * * *